United States Patent [19]

Ferris et al.

[11] 4,028,228

[45] June 7, 1977

[54] PROCESS AND APPARATUS FOR CLEANING VERY FINE ORE

[75] Inventors: David D. Ferris; Kenneth E. Harrison, both of Pittsburgh, Pa.

[73] Assignee: Heyl & Patterson, Inc., Pittsburgh, Pa.

[22] Filed: Feb. 2, 1976

[21] Appl. No.: 654,230

[52] U.S. Cl. ..... 209/39; 209/172.5

[51] Int. Cl.[2] ..... B03B 5/34

[58] Field of Search ..... 209/39, 172.5, 211, 209/12

[56] References Cited

UNITED STATES PATENTS

| | | | |
|---|---|---|---|
| 2,932,395 | 4/1960 | Marot | 209/172.5 |
| 3,246,750 | 4/1966 | Chase et al. | 209/172.5 X |

FOREIGN PATENTS OR APPLICATIONS

| | | | |
|---|---|---|---|
| 1,022,959 | 3/1953 | France | 209/172.5 |
| 726,757 | 3/1955 | United Kingdom | 209/211 |

*Primary Examiner*—Frank W. Lutter

*Assistant Examiner*—Ralph J. Hill

*Attorney, Agent, or Firm*—Brown, Murray, Flick & Peckham

[57] ABSTRACT

In an ore cleaning process the underflow from an ore classifying cyclone is delivered to a heavy medium cyclone where the ore is cleaned. The underflow leaving the classifying cyclone is continually measured for specific gravity and flow rate while the specific gravity of heavy medium that can be applied to the underflow is continually measured. The amount of this heavy medium and the amount of water required to be added to the underflow are continually controlled as functions of the specific gravity and flow rate thus measured, whereby a substantially constant specific gravity and flow rate of the underflow is maintained as it enters the heavy medium cyclone. Magnetic separating means receive the overflow from the heavy medium cyclone and separate the heavy medium from the ore, while other magnetic separating means receive the underflow from the same cyclone and separate the heavy medium from the rejects. The heavy medium is used again.

3 Claims, 1 Drawing Figure

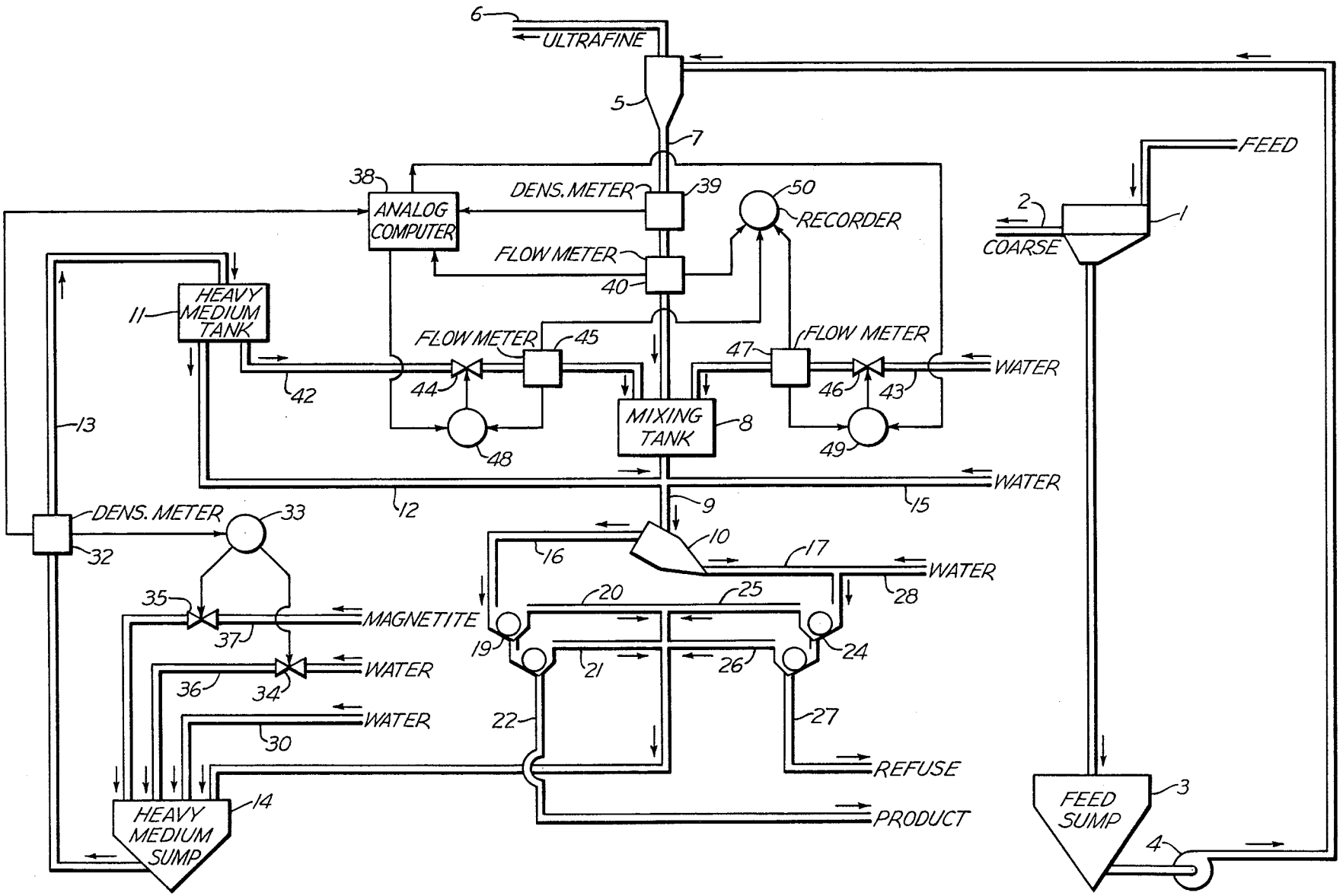
FEED
COARSE
FEED SUMP
WATER
WATER
WATER
FLOW METER
RECORDER
REFUSE
PRODUCT
MIXING TANK
ULTRAFINE
DENS. METER
FLOW METER
FLOW METER
ANALOG COMPUTER
MAGNETITE
WATER
WATER
HEAVY MEDIUM TANK
DENS. METER
HEAVY MEDIUM SUMP

PROCESS AND APPARATUS FOR CLEANING VERY FINE ORE

The separation of ore and coal from impurities by means of an artificial gravity created by a suspension of a finely ground magnetizable material, such as magnetite, in water in a heavy medium cyclone is well known. As the desired product of the separation leaves the cyclone, the conventional practice is to have it flow across drain and rinse screens to remove the water. Fine particles pass through the screens with the water. In the case of coal, for example, a considerable amount of fuel could be lost in this way if there is no limit to how fine the particles are. Twenty-eight mesh screen is about as fine as has been used, because going to finer mesh greatly increases the cost of the screens, which also must be much larger than usual. Even then, they do not do a satisfactory job.

It is among the objects of this invention to provide an ore or coal cleaning process and apparatus using heavy medium separation, in which much finer particles can be recovered than heretofore without material increases in cost, which is efficient and which produces repeatable results.

BRIEF DESCRIPTION OF THE DRAWING

The preferred embodiment of the invention is illustrated in the accompanying drawing, in which the single FIGURE is a diagram of the system.

DETAILED EXPLANATION OF THE DRAWING

The process disclosed herein requires the removal of the coarse size fraction of ore or coal before it enters the cleaning circuit. This can be done as shown in the drawing by means of a conventional screening apparatus 1, to which, for example, a mixture of coal and water is delivered. The coarse coal passes over the screen and is conducted away through a conduit 2 for further processing, which forms no part of the present invention. The rest of the coal and the water in which it is suspended pass through the screen and may be delivered to a feed sump 3, from which the slurry is transferred by a pump 4 to the inlet of a classifying cyclone 5.

In order to improve the efficiency and repeatability of the results of this new system, it is necessary to eliminate as much as possible of the ultrafine coal particles, and that is the purpose of the classifying cyclone. The ultrafine coal leaves the upper outlet of the cyclone through a conduit 6 for whatever further processing is desired, leaving presized coal in the cyclone. This also reduces the amount of water fed to the underflow outlet of the cyclone. Consequently, the stream leaving the underflow outlet through a pipe 7 includes coal, from which the coarse and ultrafine material has been removed, and a minimum amount of water.

Pipe 7 delivers the underflow to a receptacle or tank 8 that has an outlet connected by a pipe 9 to the inlet of a heavy medium cyclone 10 of well-known construction. On the way to the heavy medium cyclone, a mixture of water and magnetizable particles such as magnetite or the like is added to the slurry to provide a heavy medium of the desired specific gravity in the cyclone for separating the coal from the refuse or rejects in the flow. Thus, there is a constant flow of magnetite and water into the heavy medium cyclone from a heavy medium tank 11 through a pipe 12, preferably connected to pipe 9. This tank 11 receives the heavy medium through a pipe 13 from a heavy medium sump 14. A constant flow of water through a pipe 15 enters pipe 9.

As the heavy medium cyclone operates, clean coal and magnetite and water leave its upper or overflow outlet through a pipe 16. The refuse separated from the coal, plus magnetite and water, leave through pipe 17 connected to the lower or underflow outlet of the cyclone.

It is a feature of this invention that the overflow from the heavy medium cyclone is delivered by pipe 16 to magnetic separating means of well-known construction, preferably a two-stage magnetic separator 19. In the first stage of this separator most of the magnetite is separated from the coal and flows out through a pipe 20 connected to the heavy medium sump 14. The underflow of the first stage of the separator empties into the second stage where separation of the magnetite is completed and delivered by a pipe 21 to the sump. The underflow of the second stage leaves through a pipe 22 and includes a large amount of very fine coal particles. This coal is the desired product, which is then dewatered so that it can be used.

The underflow from the heavy medium cyclone flows through pipe 17 to other magnetite separating means, again preferably a two-stage separator 24. As in the first separator, magnetite is removed and delivered through pipes 25 and 26 to the heavy medium sump 14. The underflow from the second stage of the separator consists of a slurry of rejects and water that is carried away through pipe 27 for further processing or final dewatering. Since the underflow from the cyclone contains too high a percentage of solids for the efficient operation of a magnetic separator, it is diluted by plant water delivered through a pipe 28.

Also, the concentrate of magnetite from the two magnetic separators must be diluted by plant water delivered through a pipe 30 to the heavy medium sump 14. This is because the specific gravity of the concentrate is too high for normal operation of the system and also because of the inability of a flow rate instrument, which is used, to accurately measure the rate of flow when the percent of magnetite increases above a threshold limit established by the instrument manufacturer. Magnetite losses in this system are at a minimum.

Another feature of this invention is that a control system is provided in order to compensate for the variation in the underflow from the classifying cyclone. That is, the control system is for the purpose of maintaining a constant flow rate and a constant specific gravity in the feed to the heavy medium cyclone. This is accomplished by combining three streams in calculated proportions to produce the desired result. To calculate the flow rate and specific gravity of the heavy medium cyclone, the specific gravity and flow rate of the underflow from the classifying cyclone are measured and the specific gravity of the heavy medium being delivered through pipe 13 to the heavy medium tank 11 is measured. The control circuit controls the amount of additional heavy medium and the amount of water added to the classifying cyclone underflow as functions of the densities and flow rate that are measured as just mentioned.

To produce the desired control, a number of density and flow determining instruments or meters are used. As in the past, one density meter 32 is connected into pipe 13 to measure the density of the heavy medium flowing through it. This meter is electrically connected to a valve controller 33 is a know manner for operating valves 34 and 35 located, respectively, in a water line 36 and a pipe 37 connecting a magnetite supply with sump 14. In attempting to maintain the desired uniform density in pipe 13, the valves automatically admit more or less magnetite and water to the sump in response to signals from meter 32, which also sends a signal to an analog computer 38. This computer also simultaneously receives signals from a density meter 39 and a flow meter 40 that are connected into pipe 7 and monitor the underflow from cyclone 5.

The purpose of the computer is to determine how much additional magnetite and/or water should be added to the underflow from classifying cyclone 5 in order to maintain the desired flow rate and specific gravity of the heavy medium at the heavy medium cyclone. Accordingly, a pipe 42 connects heavy medium tank 11 with mixing tank 8, and another pipe 43 connects a water source to the mixing tank. Pipe 42 contains a value 44 and a flow meter 45, while pipe 43 contains a valve 46 and a flow meter 47. Valve 44 is operated by a cascade controller 48, and valve 46 is operated by a cascade controller 49. Both controllers are under the control of the computer, which is programmed to have the controllers add enough magnetite or water to maintain the specific gravity and flow rate at the proper levels. Controllers 48 and 49 also are controlled by flow meters 45 and 47, respectively, which feed signals to the controllers. Preferably, all three flow meters are operatively connected with a three pen recorder 50 so that a continuous record of the different flows is kept.

The computer control program is illustrated as follows:

DEFINITIONS $C_1$ = Constant flow of slurry to heavy medium cyclone 10

$C_2$ = Constant derived from $C_1$ multiplied by the desired specific gravity of the feed to heavy medium cyclone 10

$G_1$ = GPM of underflow from classifying cyclone 5

$G_2$ = GPM of total heavy medium flow from pipes 12 and 42

$G_3$ = GPM of total water flow from pipes 43 and 15

$G_4$ = GPM of constant heavy medium flow from pipe 12

$G_5$ = GPM of constant water flow from pipe 15

$G_6$ = GPM of control heavy medium flow through pipe 42

$G_7$ = GPM of control water flow through pipe 43

$S_1$ = Specific gravity of underflow from classifying cyclone 5

$S_2$ = Specific gravity of heavy medium $S_3$ = Specific gravity of water

EQUATIONS

I. $G_1 + G_2 + G_3 = C_1$

II. $G_1S_1 + G_2S_2 + G_3S_3 = C_2$

III. Solve for $G_3$ in equation I:

$$G_3 = C_1 - G_1 - G_2$$

IV. Substitute equation III for $G_3$ in equation II:

$$G_1S_1 + G_2S_2 + S_3\,(C_1 - G_1 - G_2) = C_2$$

$$G_1S_1 + G_2S_2 + S_3C_1 - G_1S_3 - G_2S_3 = C_2$$

V. Solve for $G_2$:

$$G_1S_1 - G_1S_3 + G_2S_2 - G_2S_3 + C_1S_3 = C_2$$

$$G_1\,(S_1 - S_3) + G_2\,(S_2 - S_3) + C_1S_3 = C_2$$

$$G_2 = \frac{C_2 - C_1S_3 - G_1(S_1 - S_3)}{S_2 - S_3}$$

VI. Substitute equation V for $G_2$ in equation III:

$$G_3 = C_1 - G_1 - \left[\frac{C_2 + C_1S_3 - G_1(S_1 - S_3)}{S_2 - S_3}\right]$$

VII. The control signal response to media control valve 44:

$$G_6 = G_2 - G_4$$

VIII. The control signal response to water control valve 46:

$$G_7 = G_3 - G_5$$

Example of the above equations, given the following FIGURES:

| | |
|---|---|
| $C_1 = 12000$ | $G_5 = 1000$ |
| $C_2 = 15300$ | $S_1 = 1.184$ |
| $G_1 = 3591$ | $S_2 = 1.40$ |
| $G_4 = 6000$ | $S_3 = 1.0$ |

I. $G_1 + G_2 + G_3 = 12000$

II. $G_1S_1 + G_2S_2 + G_3S_3 = 15300$

III. $G_3 = 12000 - 3591 - G_2$ $G_3 = 8409 - G_2$

IV. $4252 + 1.4\,G_2 + 8409 - G_2 = 15300$ $$G_2 = \frac{15300 - 4252 - 8409}{.4}$$

$G_2 = 6598$

VI. $G_3 = 8409 - 6598$ $G_3 = 1811$

VII. $G_6 = 6598 - 6000$ $G_6 = 598$

VIII. $G_7 = 1811 - 1000$ $G_7 = 811$

According to the above example, there should be a flow of 598 GPM of heavy medium through pipe 42, and a flow of 811 GPM of water through pipe 43 in order to maintain the desired flow rate and specific gravity of the slurry entering the heavy medium cyclone 10.

According to the provisions of the patent statutes, we have explained the principle of our invention and have illustrated and described what we now consider to represent its best embodiment. However, we desire to have it understood that, within the scope of the appended claims, the invention may be practiced otherwise than as specifically illustrated and described.

We claim:

1. Coal cleaning apparatus comprising a classifying cyclone having an inlet and an overflow outlet for ultrafine coal particles and an underflow outlet, means for continually delivering a stream of coal and water to the inlet of the cyclone, a heavy medium cyclone having an inlet and an overflow outlet and an underflow outlet, conduit means connecting the underflow outlet of the classifying cyclone with the inlet of the heavy medium cyclone and including a receptacle through which underflow from the classifying cyclone flows, means containing a supply of heavy medium formed from a suspension of magnetizable particles and water, means for continually delivering heavy medium from said containing means to the underflow in said conduit means, means for continually delivering water to the underflow in said conduit means, means for delivering to said receptacle additional heavy medium from said containing means and the required amount of water to maintain a substantially constant specific gravity and flow rate at the inlet of the heavy medium cyclone, magnetic separating means for receiving overflow from the heavy medium cyclone and having an outlet for separated heavy medium and an outlet for coal, magnetic separating means for receiving underflow from the heavy medium cyclone and having an outlet for separated heavy medium and an outlet for rejects, and means for conducting said separated heavy medium from the magnetic separating means back to said containing means.

2. Coal cleaning apparatus comprising a classifying cyclone having an inlet and an overflow outlet for ultrafine coal particles and an underflow outlet, means for continually delivering a stream of coal and water to the inlet of the cyclone, a heavy medium cyclone having an inlet and an overflow outlet and an underflow outlet, conduit means connecting the underflow outlet of the classifying cyclone with the inlet of the heavy medium cyclone, means containing a supply of heavy formed from a suspension of magnetizable particles and water, means for continually delivering heavy medium from said containing means to the underflow in said conduit means, means for continually delivering water to the underflow in said conduit means, means for delivering additional heavy medium from said containing means and additional water to the underflow in said conduit means, magnetic separating means for receiving overflow from the heavy medium cyclone and having an outlet for separated heavy medium and an outlet for coal, magnetic separating means for receiving underflow from the heavy medium cyclone and having an outlet for separated heavy medium and an outlet for rejects, means for conducting said separated heavy medium from the magnetic separating means back to said containing means, means for continually measuring the specific gravity and flow rate of the underflow from said classifying cyclone, means for continually measuring the specific gravity of the heavy medium returning to said containing means, and means for continually controlling the amount of said additional heavy medium and the amount of water delivered to said conduit means as functions of the specific gravities and flow rate thus measured, whereby to maintain a substantially constant specific gravity and flow rate of the underflow from said conduit means entering the heavy medium cyclone.

3. Coal cleaning apparatus according to claim 2, in which said controlling means include an analog computer, means for feeding said measurements to the computer, and valves controller by the computer for controlling the amount of said additional heavy medium and the amount of water delivered to said conduit means in accordance with said measurements.

* * * * *